US005228243A

United States Patent [19]

Noll et al.

[11] Patent Number: 5,228,243

[45] Date of Patent: Jul. 20, 1993

[54] SUPPORT FOR A MIRROR BLANK

[75] Inventors: Burton A. Noll; Stephen R. Ormsby, both of Painted Post, N.Y.

[73] Assignee: Corning Incorporated, Corning, N.Y.

[21] Appl. No.: 868,348

[22] Filed: Apr. 15, 1992

[51] Int. Cl.[5] ..... B24B 13/005

[52] U.S. Cl. ..... 51/216 LP; 51/216 R; 51/236

[58] Field of Search ..... 51/240 R, 240 T, 240 GB, 51/216 R, 216 LP, 236, 237 R, 131.1, 131.2, 277

[56] References Cited

U.S. PATENT DOCUMENTS 2,441,108 5/1948 Turner ..... 51/216 LP
4,897,966 2/1990 Takahashi ..... 51/237 R
4,917,934 4/1990 Sempolinski ..... 428/116
5,118,552 3/1991 Sempolinski ..... 428/98

*Primary Examiner*—Bruce M. Kisliuk
*Assistant Examiner*—Jack Lavinder
*Attorney, Agent, or Firm*—M. M. Peterson

[57] ABSTRACT

A support for a glass blank, e.g. a telescope mirror blank, while a surface of the blank is being ground. The support comprises a blocking body and a plurality of spaced, flexible tubes extending in a parallel pattern over the blocking body surface. At least some of the tubes are filled with an organic material that is cured to form a rigid polymer support. A second set of tubes under air pressure from an air manifold may provide an initial support for the blank while the first set of tubes is being filled and cured.

9 Claims, 3 Drawing Sheets

SUPPORT FOR A MIRROR BLANK

FIELD OF THE INVENTION

The field is large, lightweight mirror blanks for telescopes and the like. More particularly, the field is means for supporting such blanks during grinding of a surface on a blank.

BACKGROUND OF THE INVENTION

Large, lightweight mirror blanks are commonly produced from materials having low coefficients of thermal expansion (CTEs), particularly over the temperature range of $-50°$ to $+100°$ C. This minimizes the effect of temperature changes in the ambient atmosphere when measurements are made with a telescope.

Materials presently used include fused silicas and glass-ceramics having CTE values in the range of $\pm 10\times 10^{-7}/°$ C. over the 0°-300° C. range. The fused silicas currently employed are either an essentially pure silica or a silica doped with about 7.5% $TiO_2$. The latter is described in detail in U.S. Pat. No. 2,326,059 (Nordberg), and is hereafter identified as a $TiO_2$-doped, fused silica glass.

The fused silicas are customarily produced by a chemical vapor deposition process. In this process, oxide precursors, usually metal chlorides in vapor form, are introduced through a burner flame to produce molten oxide particles. These molten particles are deposited on a large support member to build up a body termed a boule.

The production process for a fused silica-type mirror blank involves the following steps:

1. Forming fused silica boules.
2. Slicing the boules to appropriate size.
3. Cutting the boules into hex shapes.
4. Fusing the hexes together at a high temperature to form a unitary blank.
5. Grinding flat, top and bottom surfaces (plano surfaces) on the blank.
6. Grinding the edge of the blank to an approximate outer diameter for the mirror.
7. Sagging the plano blank over a mandrel to a desired curvature.
8. Grinding the convex and concave surfaces of the blank to final contour.
9. Grinding the edge of the blank to a final outer diameter.

Large diameter blanks normally have high diameter to thickness ratios. Consequently, the blanks must be well supported from underneath to prevent deflection during grinding. Inadequate support during grinding allows the blank to deflect under its own weight and by the forces generated by the grinding wheel. Deflection during final grinding will result in mechanical stress in the blank, out of tolerance surface profiles, or a combination of both. If the deflection is high enough, the resulting stress may cause the blank to break on the grinder.

For a given support condition, the total stress at any location in the blank is the resultant of the internal and external forces acting at that location. Internal forces are due to effects such as CTE variations, and would be present even in a zero gravity condition. External forces are those which act on the blank from outside, such as gravity, support reactions and grinding. External stresses are also referred to as mechanical stresses.

Mechanical stress in the blank can increase the amount of material that the finisher must remove from the blank. Also, there is generally a stress limit specified for the blank. It is conceivable then that the blank could be rejected, or require extensive rework, if the combined internal and mechanical stress in the blank exceeded this limit.

In the past, lightweight blanks have been supported on blocking bodies during grinding. These bodies have been made from the same material as the mirror. A blocking body is a rigid structure which is used to support the blank from underneath, thereby limiting deflection in the blank. Typically, three blocking bodies are required in producing a convex/concave blank with ground surfaces. These blocking bodies are characterized by the shape of the top surface which supports the blank (plano, convex, and concave).

Previously, carpeting and foam rubber have been used as compliant, interface materials between the blocking body and the blank. This compensates for contour mismatches between the blank and blocking body contact surfaces. The compliant material acts as a series of springs, spreading out the support over a large area. This eliminates point loading in the blank.

The mirror material has proven to be an excellent blocking body material due to its mechanical and thermal stability. However, it is extremely expensive. As the blanks continue to increase in size, cost and capacity considerations preclude using such materials as a blocking body material.

Consequently, an effort has been made to use an alternate material, referred to in the trade as polymer concrete, for blocking bodies. This is a mixture of granite, or similar material, with 5-10% of a polymeric material as a binder. While a polymer concrete body is much less expensive than a fused silica glass, it also lacks the thermal and mechanical stability of the glass.

Another problem arises because neither the fused mirror blank, nor the blocking body, has a perfectly contoured mating surface. As a result, when the blank is placed on the blocking body, there are areas where the mating surfaces do not meet. When the former carpet or foam, spring-type, interface materials are used for support, deflection of the glass, and consequent mechanical stress, result in the workpiece during grinding. Contour mismatches then are a problem for two reasons. One is the temperature and mechanical instability of the blocking body. The other is the inability to sag blanks to exact contours.

It is then a basic purpose of the present invention to provide a novel and improved method of supporting large mirror blanks during grinding. Another purpose is to provide a method that minimizes deflection-related stresses being induced during grinding. A further purpose is to provide a method that permits use of polymer concrete, or a similar low cost material, for blocking bodies.

SUMMARY OF THE INVENTION

One aspect of our invention resides in a support for a glass blank while a surface of the blank is being ground, the support comprising a blocking body and a plurality of flexible tubes extending across the blocking body surface, each tube being spaced from adjacent tubes to form a pattern of parallel tubes covering the surface and at least some of the tubes being filled with a liquid organic material that subsequently cures to a solid in the tubes.

Our invention further resides in a method of supporting a glass blank while a surface of the blank is being ground which comprises: (a) providing a blocking body; (b) arranging a set of flexible tubes extending across the blocking body surface with each tube being spaced from adjacent tubes to form a pattern of parallel tubes covering the blocking body surface; (c) evacuating at least some of the tubes; (d) filling the evacuated tubes with a liquid organic material that cures to a solid and (e) curing the organic material to a solid in the tubes.

PRIOR ART

Applicant is unaware of any art more relevant than the practices described in the BACKGROUND section.

DESCRIPTION OF THE INVENTION

Figure 1:
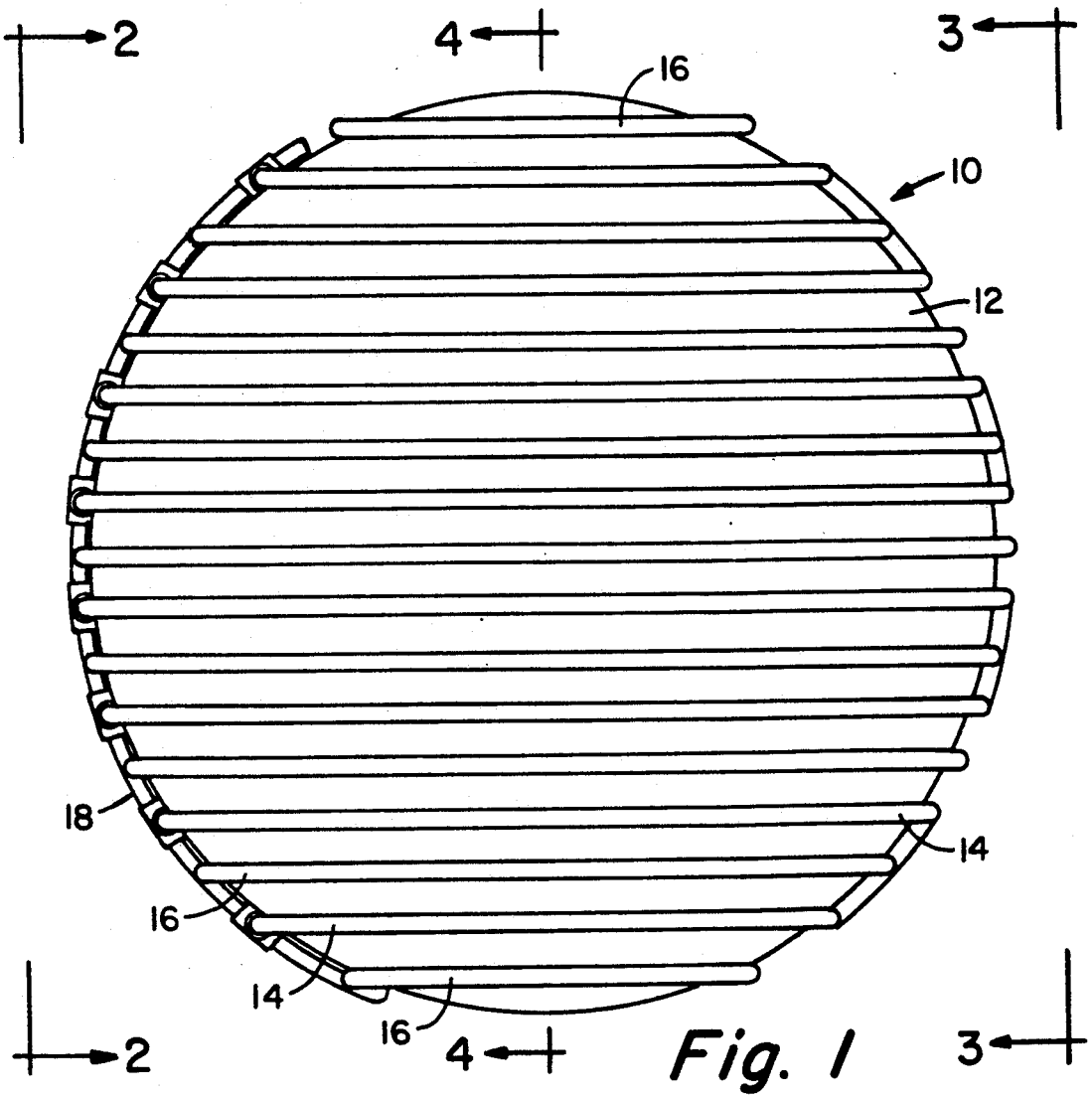
FIG. 1 is a top plan view of a support means for a glass mirror blank in accordance with the invention.

The present invention is concerned with supporting glass blanks during the grinding process. A benefit of this support method is that, as compared to prior methods, it significantly reduces mechanical stress in the the final blank. This is achieved even if there is a significant mismatch between the contours of the mating surfaces of the plate and the blocking body (or other means of support). In addition, the exact contour mismatch does not need to be known.

It is critical to support the plate in a condition as mechanically stress free as possible during the first contour grind after sagging. This is because the plate is relatively well supported by the blocking bodies during subsequent grinding operations. Consequently, mechanical stress, induced during the initial grind, cannot subsequently be relieved.

As stated previously, the conventional carpet or foam support behaves similarly to a series of springs. This tends to distribute the weight of the blank over the area of the blocking body to some extent. However, the upward force at any given point on the blank is approximately proportional to the deflection of the compliant material below. Deflections, and therefore support forces, vary significantly as contour mismatches between the blank and blocking body increase. In general, any non-uniformity in support results in increased mechanical stress in the blank.

Ideally, in order to avoid inducing deflection related stresses in a blank, the blank should be supported in a zero gravity condition during grinding. The absence of external forces would allow the blank to flex into the minimum stress state (only internal stresses from annealing would be present) while being ground. This would provide a blank having "in specification" contours and the least stress possible.

If a blank is ground using carpeting or foam as a compliant material, it is very likely that the contours on large blanks would be out of specification in a zero gravity condition. In the presence of gravity, hydrostatic support can be used to approach the ideal, zero gravity condition. An object supported on a water bed is an example of this type of hydrostatic support.

The present method of support utilizes epoxy as a compliant material for supporting the blank during grinding. This method is unique in that the blank is supported semi-hydrostatically while the epoxy cures. Once the epoxy cures, the blank is rigidly supported (by the cured epoxy) in the minimum stress condition, thus allowing the blank to be ground to contour.

We have used commercially available liquid epoxy materials, in conjunction with a hardener or curing agent, in developing our invention. Accordingly, we prefer to use such materials, and describe our invention with reference thereto. However, it is recognized that other organic materials having equivalent characteristics could be employed. The primary requirements are (1) a suitable viscosity in the liquid state to permit pumping the liquid into the tubes, and (2) curing characteristics adapted to curing the liquid to a solid or rigid state once the tubes are properly filled.

The method is said to be semi-hydrostatic due to the fact that the tubing, when compressed, exhibits spring like characteristics. The hydrostatic (air pressure) and tubing spring forces both contribute to the support of the plate.

True hydrostatic support during grinding is impractical. It would allow the blank to deflect away from the "external" force of grinding. This would prevent the profile from being accurately ground.

Figure 2:
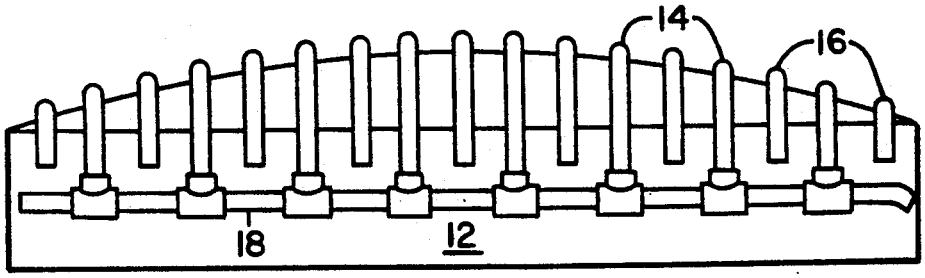
FIGS. 2 and 3 are side views of the support means shown in FIG. 1 taken, respectively, from the left hand side (2—2) and the right hand side (3—3) of FIG. 1.
Figure 3:
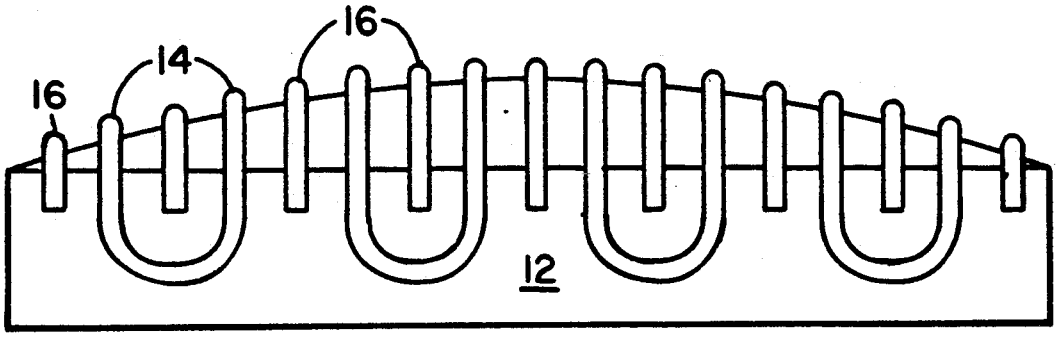
Figure 4:
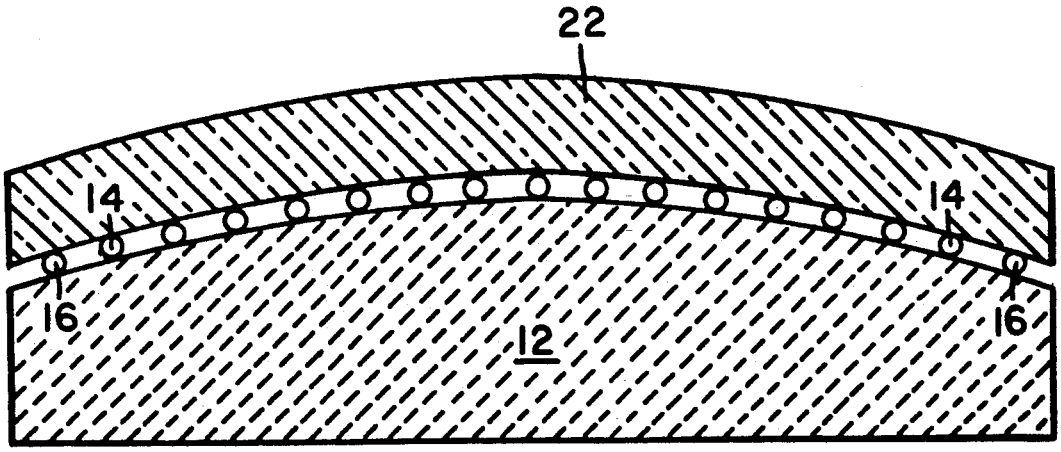
FIG. 4 is a view in cross-section taken along line 4—4 of FIG. 1.

FIG. 1 is a top plan view of a preferred support means for a glass mirror blank in accordance with the invention. FIGS. 2 and 3 are left hand and right hand side views (along lines 2—2 and 3—3 of FIG. 1) of the support means shown in FIG. 1. FIG. 4 is a view in cross-section taken along line 4—4 of FIG. 1.

FIGS. 1-4 illustrate a preferred form of a glass blank support, generally designated 10. Support 10 embodies a blocking body 12 which may, for example, be composed of polymer concrete as described earlier. Blocking body 12 has two sets of flexible tubes 14 and 16 arranged over its upper surface. Tubes 14 are connected to an air manifold 18 that is adapted to supply air to tubes 14 under a determined pressure. Tubes 16 are each adapted to be evacuated and filled with an organic material, for example an epoxide, which cures to a rigid body on standing.

Tubes 14 and 16 are lengths of thin wall, flexible, plastic tubing. This enables the tubes to exhibit the desired support characteristics when filled with air or liquid. They may, for example, be ⅝" (1.5 cm) inner diameter tubing having a thin wall and low durometer. The tubes are closely spaced, the spacing being calculated on the basis of permitted deflection. This may be on the order of a few thousandths of an inch or less. In the arrangement shown in FIGS. 1-4, tubes 14 and 16 alternate with each other. All of the tubes are arranged in parallel so that they are essentially equally spaced.

In one example, a four meter (158") diameter mirror blank was supported for grinding with a maximum permissible vertical tolerance of 0.005" (0.0125 cm). Tubes 14 were spaced about six inches (15 cm) apart, and tubes 16 were equally spaced intermediate tubes 14. The 80 grit convex contour was ground to within +/−0.003" while the 320 grit convex contour was within +/−0.0025".

In operation, air tubes 14 are pressurized from manifold 18 to provide semi-hydrostatic support to the blank. The pressure in the manifolded tubing is then adjusted to achieve the optimum degree of collapse in the tubing to be filled with epoxy. If the pressure is too low, the tubing acts as a spring, applying more upward support to the blank in the areas of minimum gap. If the pressure is too high, the blank may not be supported at all in the areas of maximum gap (after the epoxy has cured and the air pressure has been removed).

The second set of tubes 16 is then filled with epoxy which takes the shape of the partially collapsed tubing. Once the epoxy has cured, the pressure is removed from the air manifold, and the plate is ready to b=ground. Optionally, tubes 16 can be manifolded together, and then connected to a compressed air supply, to provide the optimum collapse of the filled tubing. The "epoxy" tubes are evacuated with a vacuum pump prior to filling. This prevents air from becoming trapped in the tubing. A major advantage of this method is that the epoxy is isolated from the plate and the blocking body by the tubing. This not only reduces the amount of epoxy required, but eliminates the need for any release agents.

Figure 5A:
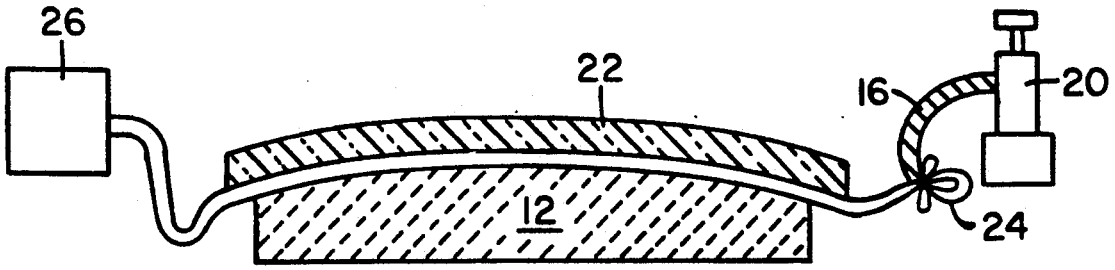
FIGS. 5*a*, 5*b* and 5*c* are schematic views showing steps in the process of filling a support tube with an organic material.
Figure 5B:
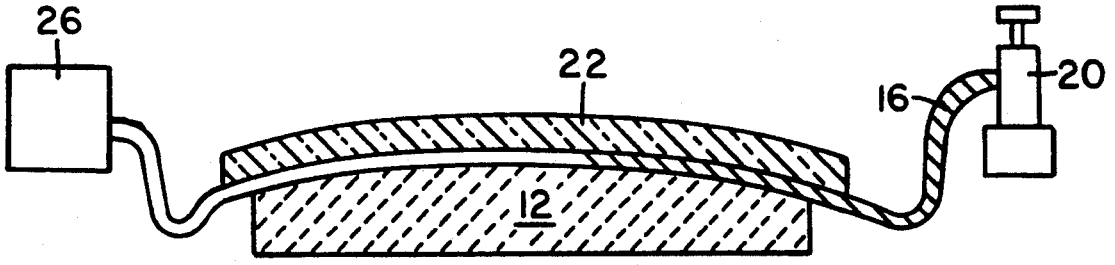
Figure 5C:
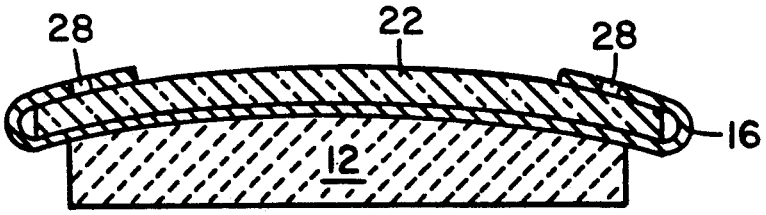

FIGS. 5*a*, 5*b* and 5*c* are schematic views illustrating the filling of a single tube 16 with liquid epoxy. Preferably, each tube 16 has a pump 20 provided to pump the liquid epoxy into the tube. While the tubes could be manifolded, the viscosity of the liquid is such that an undue amount of time is consumed in the filling operation. Meanwhile, the epoxy may start to cure, thus setting up in the tube and preventing completion of filling.

FIGS. 5*a*, 5*b* and 5*c* show tube 16 positioned between blocking body 12 and a glass blank 22. Referring back to FIGS. 1–4, tubes 16 will each be positioned between a pair of air tubes 14. The latter support blank 22 while tubes 16 are being filled.

FIG. 5*a* shows tube 16 attached to epoxy pump 20. Tube 16 is closed off at 24 while it is evacuated by vacuum pump 26. FIG. 5*b* shows the epoxy formulation being pumped in tube 16 by epoxy pump 20 while the tube is being evacuated by vacuum pump 26. Once tube 16 is filled, the pumps are removed and the tube vented to air. The ends of tube 16 are then folded over the edge of blank 22 and secured by taping 28, as illustrated in FIG. 5*c*.

The support system and method just described is preferred because of the flexibility that it offers in use. Thus, the tubes under air pressure can be adjusted to a desired level, and the mirror blank positioned before pumping the epoxide formulation into the alternate tubes.

However, it will be apparent that, under some circumstances, the air tubes can be dispensed with. This is especially the case when tubes 16 are in a concave profile. In that case, only tubes 16, to be filled with epoxy, are arranged over the blocking body. Tubes 16 are then filled with the liquid epoxy.

As described above, the tubes may be filled individually. Alternatively, the tubes can be manifolded together and connected to a compressed air supply to provide the optimum collapse of the filled tubing. While the epoxy remains liquid, the blank is positioned with the liquid in the tubes providing the semi-hydrostatic support. With the blank positioned, the epoxy can then be allowed to harden by curing. This then provides a rigid support as described earlier.

In this latter procedure, care must be taken to ensure the tubes are completely filled with the liquid, and the blank positioned thereon, before the curing starts. Consequently, while the procedure is simple, its principal use would be with small blanks where filling can proceed rapidly.

We claim:

1. A support for a glass blank while a surface of the blank is being ground, the support comprising a blocking body and a plurality of flexible tubes extending across the blocking body surface, each tube being spaced from adjacent tubes to form a pattern of parallel tubes covering the surface and at least some of the tubes being filled with a liquid organic material that subsequently cures to a solid in the tubes.

2. A support in accordance with claim 1 wherein the plurality of flexible tubes are equally spaced from adjacent tubes.

3. A support in accordance with claim 2 wherein the tube spacing is determined on the basis of permissible deflection in the glass blank.

4. A support in accordance with claim 1 wherein the blocking body is composed of polymer concrete.

5. A support in accordance with claim 1 wherein the flexible tubes are lengths of thin wall plastic tubing.

6. A support in accordance with claim 1 wherein the organic material is an epoxide material that cures to a solid epoxy.

7. A support in accordance with claim 1 further comprising an air manifold at least partially surrounding the blocking body and a plurality of flexible tubes attached to the air manifold, each such tube being arranged intermediate to and parallel with each pair of flexible tubes to be filled with a liquid organic material.

8. A support in accordance with claim 7 wherein the air manifold and the tubes attached thereto are pressurized to a predetermined level to semi-hydrostatically support a glass blank.

9. A support for a glass blank while a surface of the blank is being ground, the support comprising a blocking body, an air manifold at least partially surrounding the blocking body, a first set of flexible tubes attached to the air manifold, the first set of tubes extending across the blocking body surface at spaced, parallel intervals to form a pattern of parallel tubes covering the blocking body surface, the air manifold and the tubes attached thereto having a predetermined pressure level to semi-hydrostatically support a glass blank, a second set of tubes with each tube in the set intermediate of and parallel with an adjacent pair of the first set of tubes, the second set of tubes being filled with a liquid organic material that cures to a solid in the tubes.

* * * * *